US006006758A

United States Patent [19]

Thorne

[11] Patent Number: 6,006,758

[45] Date of Patent: Dec. 28, 1999

[54] METHOD AND DEVICE FOR THE DETECTION AND REMOVAL OF HEAD LICE

[75] Inventor: Barbara L. Thorne, University Park, Md.

[73] Assignee: University of Maryland, College Park, Md.

[21] Appl. No.: 09/243,537

[22] Filed: Feb. 3, 1999

Related U.S. Application Data

[60] Provisional application No. 60/073,505, Feb. 3, 1998.

[51] Int. Cl.[6] ..... A45D 24/04

[52] U.S. Cl. ..... 132/139; 132/137; 132/142; 132/157; 132/212

[58] Field of Search ..... 132/126, 137, 132/138, 142, 139, 200, 152, 159, 153, 154, 125, 219, 149; 119/604, 625, 630, 631, 632, 633

[56] References Cited

U.S. PATENT DOCUMENTS

D. 274,658 7/1984 Saferstein et al. .
D. 353,915 12/1994 Lanne .
4,502,498 3/1985 Saferstein et al. .
4,671,303 6/1987 Saferstein et al. .
4,807,652 2/1989 Bachrach .

*Primary Examiner*—Gene Mancene
*Assistant Examiner*—Pedro Philogene
*Attorney, Agent, or Firm*—Watson Cole Grindle Watson, PLLC

[57] ABSTRACT

A method and comb device for detection and removal of human head lice, and eventual elimination of the lice infestation, from infested individuals by sequential combing, with no use of pesticides. The comb device has six sides, three of the sides of the comb having sets of differently sized and spaced teeth so that hair can be detangled, first with the thick, widely spaced teeth on side (1), and then with the standard comb teeth on side (2), and then the thin, closely spaced teeth of the lice removal side (3) can be used to comb out lice. The method also be used to inspect for lice, with the capability of detecting lice at an earlier stage in an infestation than possible with the current, traditional inspection method (visual searching for nits or lice eggs.) Inspection can be used to screen individuals for lice (such as early in a school or camp term when all children are checked, or to detect if an infested child's family members also have lice), or it can be used to periodically monitor previously infested people to confirm that the lice have been eliminated.

14 Claims, 1 Drawing Sheet

30
31
20
21
10
41
40

5
5

4
41b
41c
4

10a
10b
41
41c 41b
41a

METHOD AND DEVICE FOR THE DETECTION AND REMOVAL OF HEAD LICE

RELATED APPLICATIONS

This application claims priority from U.S. Provisional Application No. 60/073,505, filed Feb. 3, 1998, the contents of which are incorporated herein by reference.

FIELD OF THE INVENTION

The present invention relates to a method and comb device for the detection and removal of lice.

BACKGROUND OF THE INVENTION

Head lice are a worldwide problem. Human head lice (scientific name *Pediculus humanus capitis*) are tiny parasitic insects that live on the head of a human host, sucking small amounts of blood from the scalp and laying eggs (called NITS) on individual shafts of hair. Head lice are found only on the scalp, and do not live on eyebrow, beard, armpit, or genital hair. Human head lice survive only on people and do not infest pets.

Adult head lice are small, measuring only about 1/16–1/8 inch (1–3 mm) long. They are greyish in color, but turn reddish-brown after they have had a blood meal. Lice have three pairs of legs with elegant, hook-like claws that they can use to hold very tightly to a strand of hair. They are not bothered or removed by shampooing, swimming, brushing, or scratching.

The eggs or nits are tiny (less than 1/16" long) and are shaped like elongated, oval beads. Unhatched eggs are normally pearly white to yellowish white. As the female lays an egg, she glues it to a single strand of hair with a natural cement that rivals super glue in strength. Nits hatch approximately 7–10 days after being laid. Human blood is their only food. In order to survive, young lice must feed shortly after emerging from the egg.

Lice grow in three developmental stages, characterized by three size gradations. They become mature adults sometime between 8 days and 2 weeks after hatching. The time that a louse remains in the egg and as an immature entity varies depending on the individual louse and on temperature and humidity, but in general the time between generations is 15–24 days.

A single female louse lays about 3 eggs per day; occasionally as many as 6 eggs. She can survive for 20–30 days, meaning that she may deposit 60 to well over 100 nits in her lifetime, all on a single human head, or on more than one person if she has an opportunity to travel. This is how lice infestations build so quickly—the life cycle is short and each female louse has a remarkable egg laying capacity.

Head lice bites sometimes cause mild to severe itching due to irritation of the scalp, but in many children they are painless and do not cause the child to scratch. It often takes a while for an infestation to become obvious enough to detect. Detection of lice is usually visual. Unfortunately, lice and their eggs are difficult to see and can be easily missed even by careful parents and school nurses. One must examine the entire scalp and hair for nits (eggs) or lice, a meticulous process that is helped considerably by a magnifying glass, good light, and ample patience.

Lice hide among hairs, so their eggs are usually the first visible sign of a problem. Nits may be confused with dandruff because they are about the same color and size, but dandruff can be easily brushed or blown away. Nits are very securely attached to a strand of hair and are difficult to move or remove even after repeated scraping with a fingernail.

Human head lice are crawling insects; they cannot fly or jump. Lice can travel from one head to another when hair touches, as when children are playing or napping together. Lice may also catch a ride to a different head if they move onto a shared comb or hair brush, or if one crawls onto an article of clothing such as a hat or scarf that is borrowed by another child. Even jackets can transmit lice if one harbors a lurking louse around its collar, and another coat is in contact as they hang close together in a classroom or closet. Lice can also be spread by shared earphones and headsets. Lice must find a new human head within a day or two of leaving their original host so clothing or other articles that have not recently been in circulation among infested children will be safe, assuming that there are no nits on the item. Nits hatch in 7–10 days on or off the host, so detached hair strands with eggs, in a hairbrush for example, remain a risk for transmission to another person, or even back to the brush owner. Hairbrushes should be treated to kill nits. Hats and jackets should be visually inspected for loose hairs with nits.

The length of time that a louse egg or bug can survive away from a person becomes an important issue in understanding how long there is a risk of transmission of lice without direct head contact (on a shared bed or cap, for example). A natural mode of dispersal for a louse is to crawl off of one head, onto a pillow for example, and to hover in that vicinity, hoping that another person will lay his or her head nearby. However, lice will succumb without a source of nutrition. In order to survive, lice need to feed on blood. The scientific data vary somewhat, but studies show that most lice die within 2 days off of a host head, and that all die within 4 days.

Lice eggs (nits) can remain alive off of a person for up to 10 days (on a strand of hair caught in a hair brush, for example). If the juvenile louse hatches and then is brushed onto a head, it can feed and thrive. The combs and brushes used by an infected person are obviously high risk zones for lurking lice. These devices should be treated with for example hot water and/or isopropyl alcohol to reduce the risk of new primary infestations and secondary infestations.

In the United States most doctors and school nurses currently recommend pesticidal shampoos which put noxious chemicals in direct skin contact of treated individuals. Many strains of head lice now appear to be resistant to pesticidal shampoos and even to formulations containing pyrethroids, permethrin, or lindane, which are sometimes prescribed by physicians.

There are a number of "home remedies" that have strong followings among veterans of head lice infestations. There is no scientific data on the efficacy of these approaches, but neighborhood testimonials may persuade one to try one or more. The "oily goop" technique is based on the premise that lice, and their eggs, will die if they can't breathe, and if they are smothered in oil for a sufficiently long period of time, they will die. Choice of preferred oil application is personal: options include such things as petroleum jelly, olive oil, and mayonnaise (regular, not low fat). The entire scalp and all hair must be heavily coated with the oily goop, and it should be massaged in so that lice and their eggs are coated. There is a bit of art involved in this approach because no one is certain of how long the oil should be kept on to ensure suffocation of lice or nits, but the general rule of thumb in common practice is at least about 30 minutes, sometimes overnight.

These sessions are obviously messy. Many people attempt to contain the goop with a shower cap. Grease cutting dish detergents are probably the best recourse in attempting to wash out an oil treatment, but it may take repetitive efforts.

Another widespread approach to lice control is to apply tea tree oil, either straight or in a shampoo. Tea tree oil is available in many stores with natural health products and oils, and the shampoos are often sold in beauty parlors. Some families claim success by using a hair dryer to heat the head and hair, and thereby kill the lice, but lice are hardy critters and this procedure may well hurt the child more than it harms the lice.

In addition to chemical methods for removing lice from human heads, mechanical techniques involving the use of combs are known. However, commonly used combs for this purpose have teeth which are not sufficiently closely spaced (especially at their free ends) to be effective, and the ends are sharp and thus pose a hazard when used on small children. In addition, the free ends of the teeth form a convex edge which reduces the effectiveness of the comb.

Given the fact that chemical methods for removing lice and nits from human (children's) heads expose the infected person to dangerous chemical agents, a need exists for a simple and effective non-chemical method for removing lice and nits from human heads.

Thus, an object of the present invention is to provide such a non-chemical method for removing lice and nits from human heads, such a non-chemical method avoiding the application of pesticides to a human's head.

It is another object of the present invention to provide a comb device which can be used to accomplish the inventive method.

It is another object of the present invention to provide an improved method for detecting lice at an early stage in an infestation and for confirming that lice have not returned to a person who has been previously rid of lice and nits.

SUMMARY OF THE INVENTION

According to the present invention head lice are detected and thereafter removed along with nits in a non-chemical method by moving a first set of comb teeth through the hair of a person's head so as to expose for view the presence of lice, this set of comb teeth also providing a gross detangling of the person's hair, and then moving a second set of comb teeth through the person's hair so as to catch and remove both lice and nits in the hair and on the scalp. A third set of comb teeth can be moved through the person's hair between use of the first and second sets of comb teeth to achieve a further detangling of hair prior to use of the second set. The third set of comb teeth are spaced apart about the width of a human's hair whereas the first set of comb teeth are more widely spaced apart for detangling purposes.

Also according to the invention a multi-sided comb device is provided which includes all three sets of comb teeth for use in the inventive method.

The method is practiced as follows:

Before beginning the combing process, hair and scalp are thoroughly wetted. Wetting hair of a suspected infested head or an infested head is a preferred first step. Preferably wetting is accomplished with water, although other non-toxic liquids or vegetable oils can be used. Lice move more slowly in wet hair and this will provide an opportunity to catch the lice while they are relatively sedentary. Wetting may be accomplished in a bath or shower by soaking the head under a faucet of running water and then lightly toweling the hair before placing a dry towel around for instance a child's neck as the child sits comfortably for the combing. For long, curly, or thick hair it helps to apply a detangling solution such as Johnson & Johnson "No More Tangles"™ or other detanglers available where hair care products are sold. The detangler can be left in during the combing process.

The second and third steps of the invention are preparatory steps leading up to the use a very fine toothed comb for combing out lice. The second step uses a comb with large and well spaced teeth. This comb is primarily used to detangle the hair. One combs the infested hair the entire length of all strands with the large toothed comb. Combing is repeated until the comb slides easily through the whole head of hair.

In the third step of the invention a normal or standard comb (or a comb having teeth-spacing intermediate the teeth-spacing of the teeth of combs used in step 2 and the final step of the method) is used to comb all strands of the hair until it glides readily through all hair.

In a final step a fine toothed comb such as the comb shown in FIG. 6 is used. The objective is to carefully comb the entire scalp and all hair to catch and remove all lice. This comb should be rinsed with water after each pass through the hair to remove and discard lice captured from the head. The combing process begins in one part of the head and moves systematically over the entire scalp. One should part the hair in small sections to ensure that all hairs pass through the comb, and to make certain that all sections of the head are eventually combed. The hair is combed from tight against the scalp down the entire length of the lock in one motion. For long hair it is helpful to use clips to hold back some sections of the hair while other areas are being combed. After each pass through the hair, the comb is inspected for lice (or the occasional nit that may come off), and the comb is exposed to running hot water to remove bugs or eggs. Sometimes an old toothbrush or similar tool can be useful in dislodging lice from the comb. Repeat hair combing with the finest-spaced tooth comb until repeated combing yields no more lice.

The wetting-combing sessions are to be repeated daily for the first week and thereafter every other day for the next two weeks. Nits not removed in the combing process will hatch within approximately ten days after being deposited; frequently combing catches newly hatched lice.

At the beginning of the process one may be dealing with a heavy infestation. For long hair, the first day's complete combing sequence may take 20 or 30 minutes because it must be thorough. It is essential to comb the entire scalp and all of the hair. Of course, the goal is to remove all lice, but it is most important not to miss the big ones—the adults—because egg production is to be halted.

After the second or third day of sessions, the largest of the lice, the mature parents, will have been removed. If large lice remain after 4 days, either combing has not been sufficiently thorough, or the patient is being reinfested through contact with someone else who has lice.

The combing process should be continued daily for one week, and then every other day for two more weeks. Care should be taken to retain this schedule, but if a day is skipped inadvertently, the program should not fail.

To confirm that no lice eggs hatched abnormally late, and that the patient is not reinfested by a friend caught in the same head lice epidemic, it is prudent to be persistent about periodically checking for lice even after the first 3 weeks of combing. This can be accomplished every couple of days by conducting a wetting-combing session as above described for several weeks (conveniently done after a shower for example). Check the finely-spaced toothed comb after each pass though the hair to verify that the person is free of lice. If a louse is found, one needs to return to a more frequent combing schedule. If the louse was large the possibility exists that it could have laid eggs. In that event wetting-combing session should be conducted for 2 more weeks to catch young lice as they hatch.

The meticulous nuisance of removing nits is not necessary when practicing the method of the invention. No additional eggs will be laid after hatched lice are removed with the comb. Eggs already present on the hair may hatch, but then those young lice will be combed off the next day. Nit removal is appealing because, understandably, one wants to be entirely rid of the infestation as quickly as possible. However, even if one takes the time and the trouble of extracting nits, daily wetting-combing sessions must be conducted. The infestation may build again even if two nits remain hidden and combing is neglected.

In cases of very heavy infestations one may want to remove as many nits as possible. Soaking hair in a warm solution of ½ vinegar and ½ water for 10–30 minutes before combing may help with nit removal.

The comb of FIG. 6 and other lice combs (most all of which target the eggs and as a result pull at the hair, making it uncomfortable for the person with the infestation and less likely that the person will remain or even return for further treatments) may help with nit removal, but cannot be counted on to dislodge every egg and thereby eliminate an infestation by itself.

The technique of the invention is a simple and straightforward approach to the problem of head lice. If careful combing is done each day, there is little chance of lice transfer between children.

The comb device of the invention will be itself better understood by reference to the attached drawings taken in conjunction with the following discussion.

DETAILED DESCRIPTION OF THE PREFERRED EMBODIMENT

Figure 1:
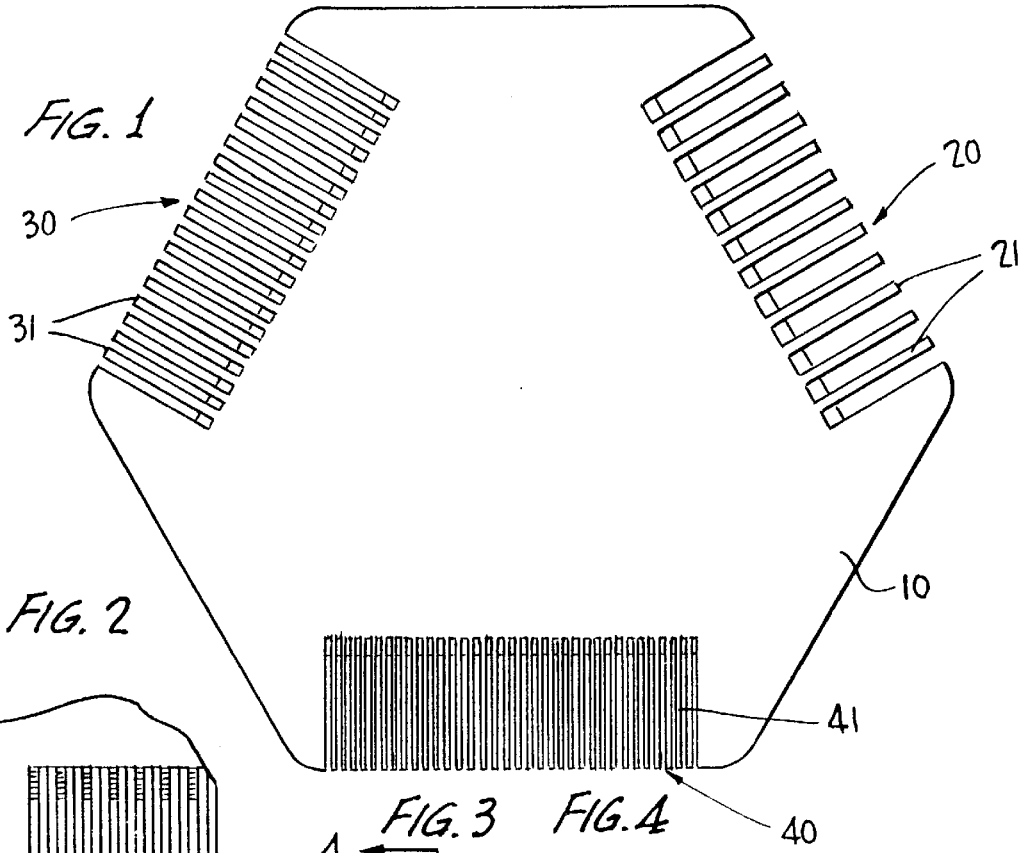
FIG. 1 is a top plan view of a comb device according to a preferred embodiment of the present invention.
Figure 2:
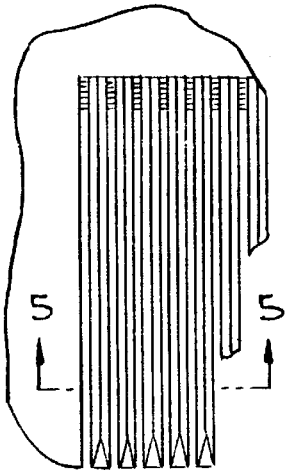
FIG. 2 is an enlarged detail of the tooth set of the comb device of FIG. 1 which is effective in removing lice and nits from the hair and scalp of a user.
Figure 3:
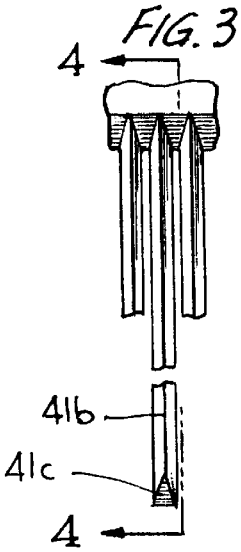
FIG. 3 shows three of the teeth, two being broken away, of the teeth set shown in FIG. 2 and their connection to the body of the comb device.
Figure 4:
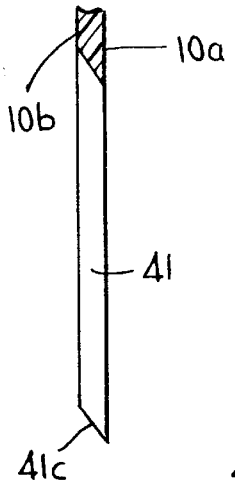
FIG. 4 is a view of FIG. 3 as seen along line 4—4.

A comb device according to a preferred embodiment of the present invention is shown in FIGS. 1–5. It is seen to be in the form of a relatively flat body 10 that forms six sides, three of which are constructed to provide tooth sets 20, 30 and 40. These sets are separated by body sides that do not have teeth and have similar lengths.

The tooth set 20 includes parallel teeth 21 which are about 0.75 to 1 inch in length, have a width of about 1/16 to 1/8th inch, and are spaced apart by a distance of about 1/8 to 1/4 inch. The teeth can have circular or triangular cross sections. Due to the relatively large spacing between the teeth 21, this tooth set is useful in achieving a gross detangling of hair on a human head.

The tooth set 30 includes parallel teeth 31 which correspond in all respect to teeth 21 of tooth set 20 except that they are spaced apart by a distance between about 0.15 mm to 1/8 inch; thus more closely spaced than teeth 21. As such, this tooth set is useful in achieving a fine detangling of hair on a human head.

Figure 5:
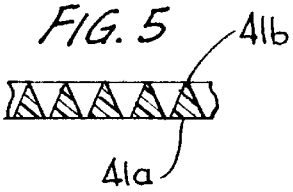
FIG. 5 is a view of FIG. 2 as seen along line 5—5.
Figure 6:
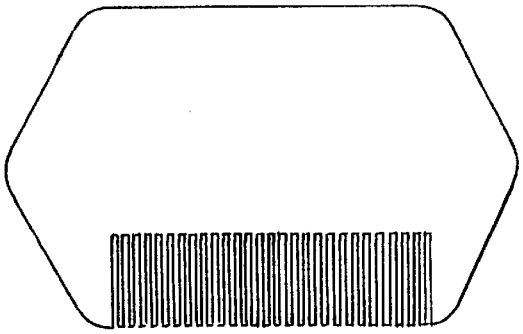
FIG. 6 is a top plan view of a comb having a single tooth set.

The tooth set 40 includes parallel teeth 41 which are similar in length to teeth 21; however, they are more closely spaced, i.e., by a distance between about 0.08 to 0.2 mm, which is about equal to the width dimension of the hair on a human's head. As seen in FIG. 5, these teeth have a generally triangular cross section, with a flat side 41*a* of each being parallel to a plane defined by surface 10*a* of body 10 and opposite edges 41*b* of each falling in a plane parallel to the opposite surface 10*b* of body 10. Each tooth has a base portion that extends from a sloped ledge 10*c* formed by the body 10 to a generally flat free end 41*c*, the generally flat free end being sloped outwardly relative to body 10 from edge 41*b* to flat side 41*a*. The sloped ledge 10*c* forms a lice catcher (similar in concept to a cow catcher at the front of a locomotive). The generally flat free ends 41*c* of the teeth 41 are the portions of the teeth that are to be placed on the scalp for combing hair and enable the comb device to conform more closely to the scalp (the comb device is held by the user so that the body side 10*b* faces the user's scalp).

The comb device can be fabricated from any acceptable, non-brittle plastic such as, for instance, polypropylene or polyurethane. Ideally it is colored differently from the color of lice and nits. This color may be a shade of blue or turquoise. It can be manufactured by injection molding or by pouring resin or polymer components into molds and curing the molded resin.

Although this invention has been described in specific detail with regard to specific embodiments, modifications may be made to comb device without departing from the scope of the invention. The comb may be fabricated, for instance to have more than one row of teeth in each tooth set. Comb device 10 may have three, four, five, six, seven or more sides. The ends of the teeth can be concave instead of generally flat. Thus, except where necessary for operability, no limitation to these specific materials is intended, nor should such a limitation be imposed on the claims appended hereto.

I claim:

1. A method of detecting and removing lice and lice eggs from head hair of a person, comprising the steps of:

(a) wetting the person's hair;

(b) passing a first set of comb teeth through the person's hair to inspect for lice and detangle the hair; and (c) passing another set of comb teeth through the person's hair to remove lice and lice eggs, said another set of comb teeth being comprised of teeth of a size and spaced a distance equal to the width of a hair on a human's head such that lice are trapped by said teeth and removed when said set of comb teeth is passed through said hair.

2. The method of claim 1, comprising passing a further set of comb teeth through said hair between steps (b) and (c) to further detangle said hair.

3. The method of claim 1, comprising applying a detangler to the hair prior to step (b).

4. The method of claim 1, wherein no pesticides are used.

5. A comb device for detecting and removing lice and lice eggs from hair, comprising:

a solid body defining at least three sides, wherein three of said at least three sides comprise a set of comb teeth extending outwardly from said solid body, a set of teeth at a first side of said body which have a thickness and which are spaced apart such that said teeth, when passed through moistened hair, detangle said hair, and a set of teeth at a second side of said body which have thickness and which are spaced apart a distance equal to the width of a human head hair such that said teeth, when passed through detangled hair, remove lice and nits from said hair.

6. The comb device of claim 5, wherein a set of teeth at a third side are spaced apart a distance intermediate the distance the sets of teeth at said first and the second sides are spaced apart.

7. The comb device of claim 5, wherein the teeth of said set of teeth at said second side of said body have a generally triangular cross section and are spaced apart by a distance of between about 0.08 and 0.2 mm.

8. The comb device of claim 7, wherein the teeth of said set of teeth at said second side of said body have free ends which are generally flat and sloped.

9. The comb device of claim 8, wherein said solid body is generally flat and defines opposite first and second surfaces which lie in first and second parallel planes, wherein a flat side of each tooth of said set of teeth at said second side of said body lies in said first plane and an opposite edge thereof lies in said second plane, and wherein said flat free end of each tooth is sloped outwardly relative to said body from said opposite edge thereof to said flat side thereof.

10. The comb device of claim 9, wherein the teeth of said set of teeth at said second side of said body have bases connected to a ledge defined by said body, said ledge being sloped outwardly of said body from said second plane to said first plane.

11. The comb device of claim 5, wherein said body and teeth are formed of plastic.

12. The comb device of claim 5, wherein said body and teeth are blue in color.

13. The comb device of claim 5, wherein said body defines six sides.

14. The comb device of claim 5, wherein said body and teeth are turquoise in color.

* * * * *